US008806729B2

(12) United States Patent
Roddy et al.

(10) Patent No.: US 8,806,729 B2
(45) Date of Patent: Aug. 19, 2014

(54) APPARATUS FOR ALIGNMENT AND SUPPORT OF FENCE RAILS

(76) Inventors: Kenneth Joe Roddy, Garland, TX (US); Jeffrey Roddy, Richardson, TX (US)

( * ) Notice: Subject to any disclaimer, the term of this patent is extended or adjusted under 35 U.S.C. 154(b) by 248 days.

(21) Appl. No.: 13/564,711

(22) Filed: Aug. 1, 2012

(65) Prior Publication Data

US 2013/0032774 A1 Feb. 7, 2013

Related U.S. Application Data

(60) Provisional application No. 61/513,788, filed on Aug. 1, 2011, provisional application No. 61/523,978, filed on Aug. 16, 2011, provisional application No. 61/526,543, filed on Aug. 23, 2011, provisional application No. 61/530,015, filed on Sep. 1, 2011, provisional application No. 61/580,144, filed on Dec. 23, 2011.

(51) Int. Cl.

| | |
|---|---|
| ***B23P 11/00*** | (2006.01) |
| ***E04H 17/26*** | (2006.01) |
| *E04H 17/14* | (2006.01) |

(52) U.S. Cl.

CPC ..... *E04H 17/26* (2013.01); *E04H 2017/1447* (2013.01)

USPC ..... 29/243.55; 29/243.5; 269/43

(58) Field of Classification Search

CPC ..... B21J 15/00; B21J 15/041; B21J 15/10; B25B 5/02; B25B 5/003; B25B 5/67; B25B 5/82

USPC ..... 29/243.5–243.58; 269/43, 246

See application file for complete search history.

(56) References Cited

U.S. PATENT DOCUMENTS

| | | | | |
|---|---|---|---|---|
| 5,727,778 | A * | 3/1998 | Nodar | 269/43 |
| 8,096,540 | B2 * | 1/2012 | Claxton | 269/188 |
| 2002/0088645 | A1 * | 7/2002 | Berto | 174/158 F |
| 2005/0173853 | A1 * | 8/2005 | Maes | 269/45 |
| 2009/0184302 | A1 * | 7/2009 | Begin | 256/65.04 |
| 2013/0032774 | A1 * | 2/2013 | Roddy et al. | 256/65.04 |

* cited by examiner

*Primary Examiner* — Lee D Wilson

(57) ABSTRACT

A visualization, alignment and support tool permitting one person fence rail installation, and greatly speeding the installation when more than two persons are employed. Specifically, the tool affixes temporarily to a fence pipe and offers support for a length of fence rail; especially the ends of adjacent fence rails, so that the rails are supported and level relative to a fence pipe bracket which is affixed to the fence pipe. The rail ends can then be fastened with screws or other fasteners to the fence pipe bracket when desired without further adjustment required.

4 Claims, 10 Drawing Sheets

16
20a
18a
12
14
10'
16
20
12
20

16
14

10'
16
20a
20
14
18a
21
12

FIG.27
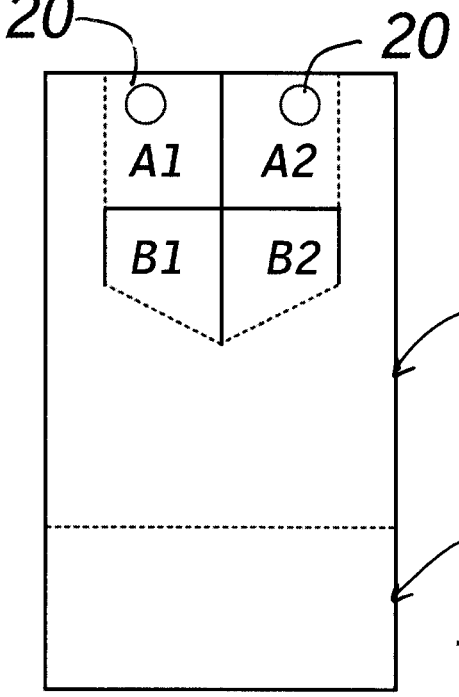
FIG.28
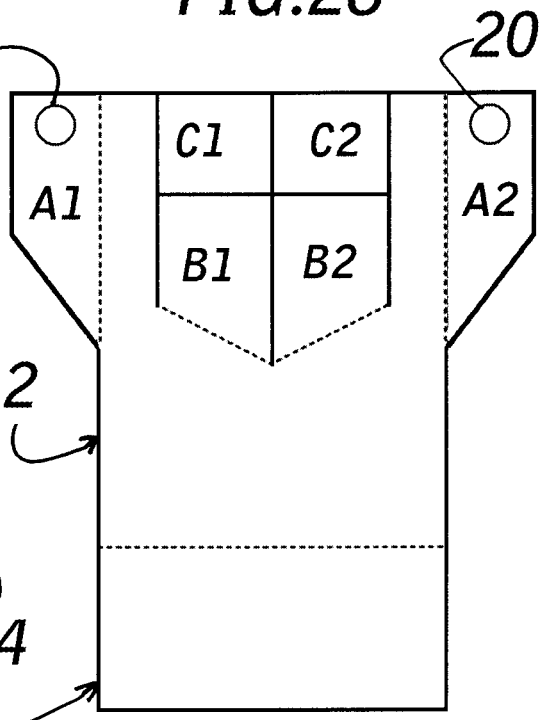
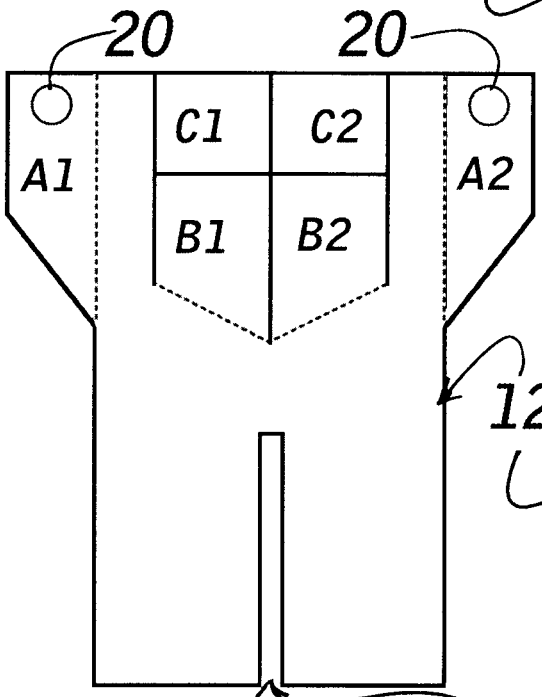
FIG.29
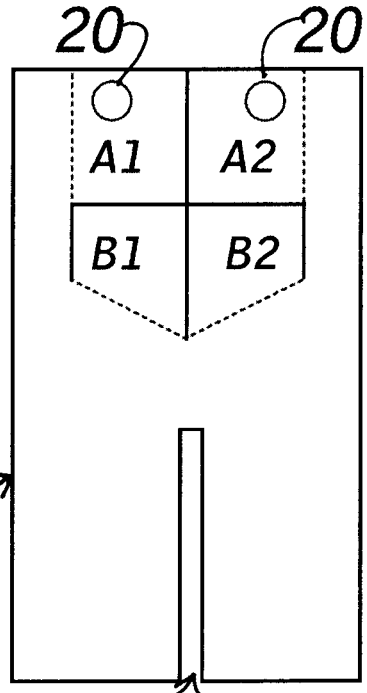
FIG.30
S

APPARATUS FOR ALIGNMENT AND SUPPORT OF FENCE RAILS

CROSS REFERENCE TO RELATED APPLICATIONS

This application claims the benefit of U.S. Provisional Patent Application No. 61/513,788 filed Aug. 1, 2011; U.S. Provisional Patent Application No. 61/523,978 filed Aug. 16, 2011; U.S. Provisional Patent Application No. 61/526,543 filed Aug. 23, 2011; U.S. Provisional Patent Application No. 61/530,015 filed Sep. 1, 2011; U.S. Provisional Patent Application No. 61/580,144 filed Dec. 23, 2011.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

FIELD OF THE INVENTION

This invention relates to the temporary support of a fence rail prior to the rail's attachment to a post bracket, especially for site-built wooden fence construction.

BACKGROUND OF THE INVENTION

Natural wood rail and post fencing is the most common type of fence in the United States. Many consider this type of fencing to be more attractive than hurricane type fencing because it combines the strength and durability of metal posts or pipe with the privacy of a wooden pickets which can be painted or stained to suit the owner's preferences. Basically, posts of galvanized pipe are connected to horizontal wooden rails by a fence pipe bracket that is affixed to the fence pipe. There are several manufacturers of pipe brackets. For the purposes of this application, the term "pipe bracket" refers generally to the type of bracket which is the subject of U.S. Pat. No. 5,297,890, currently marketed as the PGT® Pipe Grip Tie® by Simpson Strong-Tie 5956 W. Las Positas Blvd., Pleasanton, Calif. Other structurally similar fence post brackets marketed as OZ-Post™ brackets, are in the same category. These brackets have a semi-circular portion that engages a fence pipe and possess a pair of adjacent flanges for the attachment of rail ends. The terms "post" or "pipe" as used herein are intended to refer to metal pipe-type fence posts.

Fence pipe brackets are typically installed 3 to a pipe for a fence having a height of 6 feet and 4 to a pipe for an 8 foot high fence. Each pipe bracket is leveled with respect to a corresponding pipe bracket on an adjacent post. Leveling of the pipe brackets is done by string level or laser line and is an important determinant of fence quality. The last 3 or 4 inches of each rail are fastened by screws to a flange of the pipe bracket, and ideally abuts the end of an adjacent rail that is fastened to the opposite flange of the pipe bracket. In this manner a continuous progression of rails down the fence line is established. At least two people are required to attach each rail; one individual tasked with affixing the rail end to the pipe bracket, while another individual supports the rail in a level orientation; usually in the middle of the rail or at the opposite end of the rail. While rails are often immobilized by applying the weight of the body against the rail to bring the flats of the rail ends in contact with the post bracket flanges, it is not uncommon for the individual supporting the fence rail to move slightly which necessitates repeat leveling of the rail. It would be desirable to have a tool that permits automatic leveling of the rails by providing support and retention means as well as a means to center the rail relative to the bracket, so that one individual can perform the rail installation.

SUMMARY OF THE INVENTION

The present invention includes an apparatus which reduces the number of persons required for rail attachment, and greatly speeds fence construction. The apparatus affixes temporarily to the post beneath a pipe bracket and offers support for the ends of fence rails so that the rails are supported and level relative to the fence bracket.

The apparatus includes at least a platform having an opening portion which is positionable about a fence pipe, a securing member to close the opening so that the apparatus as a whole, encircles the fence pipe, a stop which retains the rail in proximity of its attachment point on a bracket flange, and a gauge for setting the distance from the fence bracket to the platform to maintain consistent alignment and centering of the rails relative to the pipe bracket flanges.

A single apparatus may be used as an extra set of hands or used in multiples, with rails placed between each member of a pair.

The platform is made of any material capable of supporting at least one-half the weight of a common 2×4×8 fence rail; typically anywhere from 5 to 15 lbs. Among others, stamped sheet metal, heat formed or molded plastic, or die-cast metal are all suitable materials singly or in combination. Whatever the materials of construction, the opening is shaped to receive a section of fence pipe, possesses regions which surround and contact an area generally not exceeding one-half the diameter of the pipe, and at least one arm that is adjacent to an entry point for the fence pipe.

The platform of the apparatus remains in position on the fence pipe primarily due to tensioning applied by a securing member engaged with the platform and in close contact with the rear of the pipe. Increased tension is provided when the securing member; preferably, wedge or a removable pin or rod with handle portion, is forced into a friction fit at the side of the fence pipe by inserting and or turning a portion of the securing member that is reversibly compressible against the side of the fence pipe. This action pulls at least a portion of the platform surrounding the opening against the side of the fence post where it is resistant to at least up and down movement on the fence pipe. The fit is sufficiently tight so that a top surface of the platform is retained in a position generally perpendicular to the fence pipe and prevented from vertical movement without loosening or removing the securing member.

In one aspect, the invention includes a securing member in the form of a pin or rod that includes a section having a relatively greater radius, and an adjacent section having a relatively lesser radius, and which operates similarly to a cam. The pin is initially inserted with the side of the platform with the section having lesser radius facing the rear of the fence pipe for clearance purposes. Once fully inserted, the securing member is turned by means of a handle or lever, forcing the section of greater radius into tight contact with the rear of the fence pipe. In another aspect, the securing member is in the form of a reversibly insertable wedge that is forced into tight contact between the platform and the fence pipe. The securing member can also take the form of a pivotable member connected to a side of the platform opening with another end of the pivotable member being nestable within a guide recess or catch on the opposite side of the platform opening in order to (1) bridge the gap of the opening and (2) assume tight contact with the fence pipe. In any aspect in this disclosure, the securing member is wedge-ably forced against the fence pipe pulling the opening of the platform into intimate contact with the fence pipe. In all aspects, the securing member can include a reversibly compressible element of a suitable shape allowing it to be brought in an out of a position that is tightly contacting a portion of the fence pipe, as for example, by a cam-shaped profile that is rotated to provide the required amount of tension, or a rubber bumper of any suitable size. Other compressible elements engaging with the platform and reversibly abutting the rear of the fence pipe will suggest themselves to those having skill in the art and benefit of this disclosure, and are intended to be encompassed by the present invention.

Other advantages of the present invention will become apparent from the following descriptions, taken in connection with the accompanying drawings wherein by way of illustration and example, a preferred embodiment of the present invention is disclosed.

BRIEF DESCRIPTION OF THE DRAWINGS

FIG. 27 is a plan view of a section of sheet metal with cut-lines for producing the embodiment shown (FIG. 22);

FIG. 28 is another plan view of a section of sheet metal with cut-lines for producing the embodiment shown (FIG. 22) with a formed channel;

FIG. 29 is another plan view of a section of sheet metal with cut-lines for producing the embodiment shown (FIG. 22);

FIG. 30 is another plan view of a section of sheet metal with cut-lines for producing the embodiment shown (FIG. 22) with a formed channel;

DETAILED DESCRIPTION OF THE INVENTION

Figures 1, 2, 3:
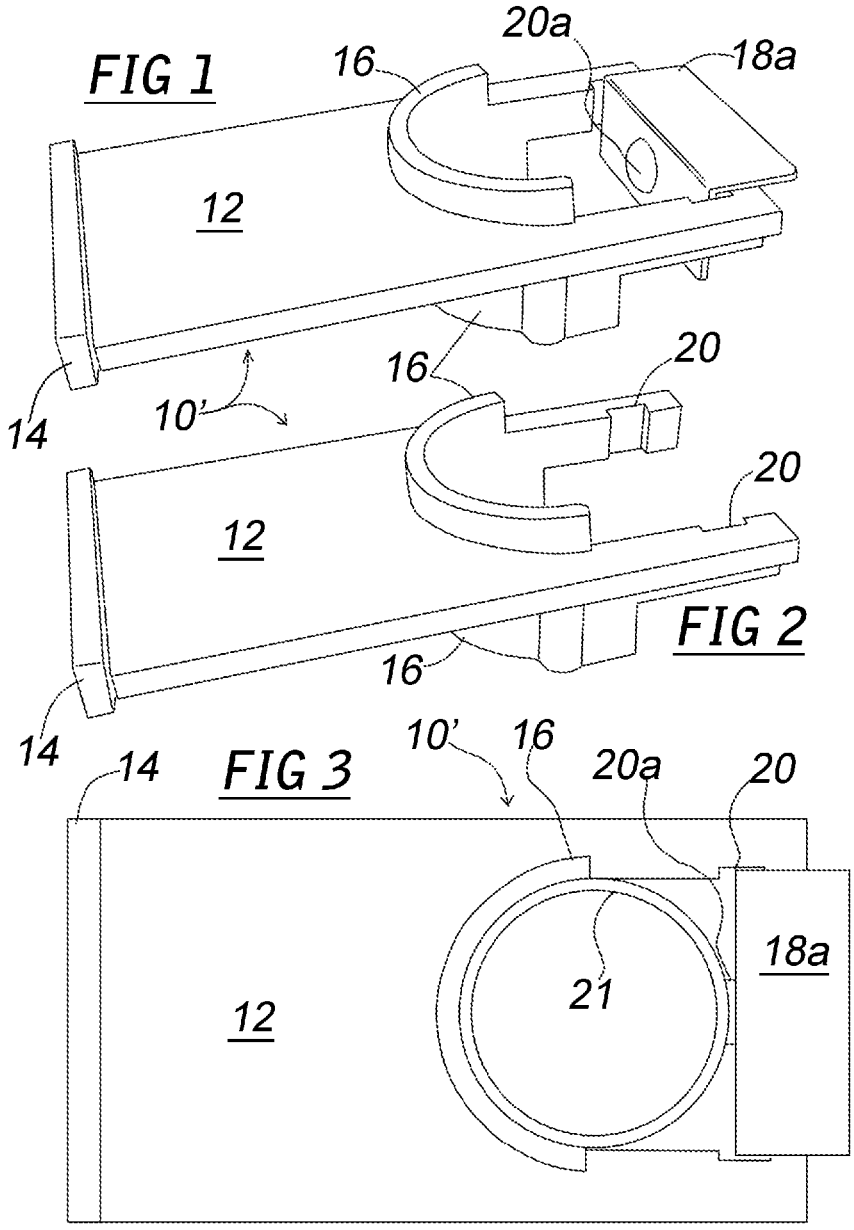
FIG. 1 depicts a side perspective view of one embodiment according to the present invention.
FIG. 2 depicts a side perspective view of the embodiment shown in (FIG. 1) according to the present invention, but with securing member 18*a* removed.
FIG. 3 is top plan view of the embodiment shown in (FIG. 1) showing the fixed ridge 18 abutting a fence pipe 21.
Figure 4:
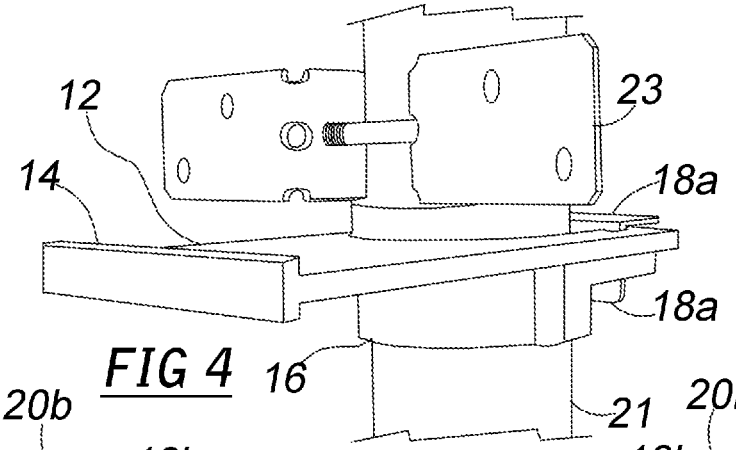
FIG. 4 depicts a perspective view of the embodiment shown in (FIG. 1) in a typical use, being attached beneath a fence pipe bracket.
Figures 5, 6:
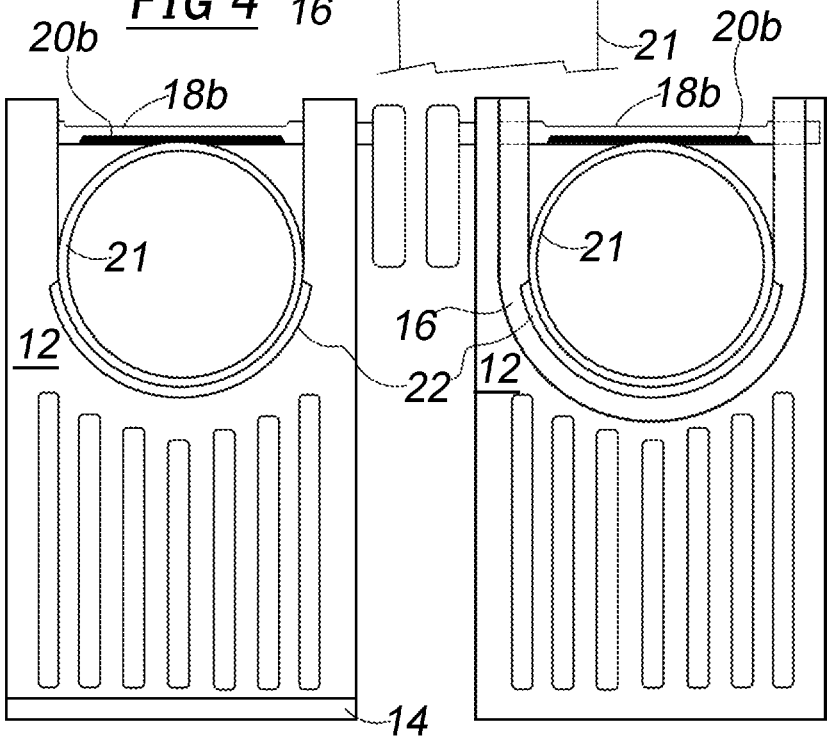
FIG. 5 depicts a top plan view of a preferred embodiment according to the present invention.
FIG. 6 depicts a bottom plan view of the embodiment shown in (FIG. 5) with fixed ridge 16 supportive of a distancing means 22*a;*
Figure 7:
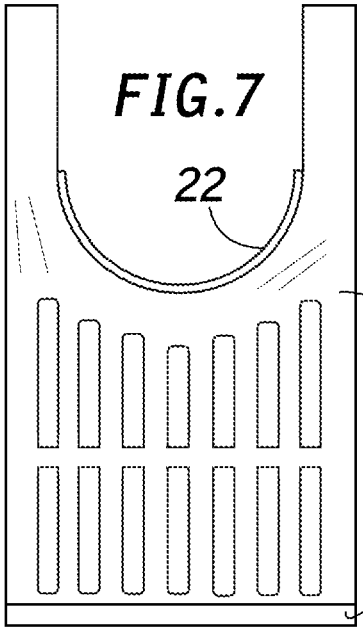
FIG. 7 depicts a top plan view of an embodiment with a distancing means being curved member 22, which is abutting fixed ridge 16, through which thumbscrew 26 passes.

Reference Listing:

10 rail support
12 platform
13 opening
14 retainer
15 slider
16 ridge
18*a*, 18*b*, 18*c* securing member
20*a*, 20*b* compressible member
20 guide for securing member
21 fence pipe
22*a*, 22*b* distancing means
23 pipe bracket
24 pin
26*a* thumbscrew
26*b* sliding nut
28 slot and recess
30 pin aperture Definitions:

In the following description, the term "platform" refers to any type of small platform supportable of a fence rail that can be easily and reversibly secured around a cylindrical pipe. For the purposes of this application, the term "fence pipe bracket" refers generally to the type of bracket which is the subject of U.S. Pat. No. 5,297,890 to Commins, which is currently marketed as the PGT® Pipe Grip Tie by Simpson Strong-Tie. Other similar fence post brackets marketed as OZ-Post™ brackets, fall under the some category. The term fence pipe or fence post as used herein is intended to refer to metal pipe-type fence posts. Unless otherwise explained, any technical terms used herein have the same meaning as commonly understood by one of ordinary skill in the art to which this disclosure belongs. The singular terms "a," "an," and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Figure 8:
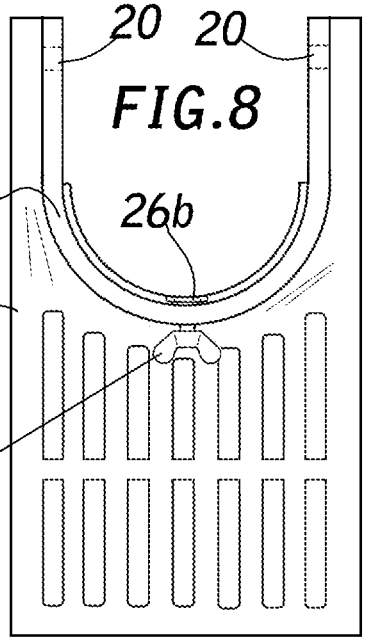
FIG. 8 depicts a bottom plan view of the embodiment shown in (FIG. 7), with a distancing means being curved member 22*a*, which is abutting fixed ridge 16, through which thumbscrew 26 passes.
Figure 9:
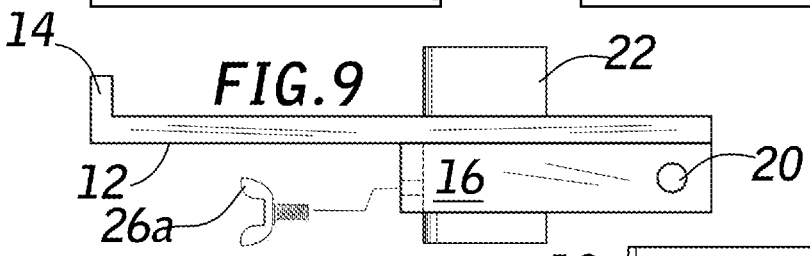
FIG. 9 depicts a side elevation of the embodiment shown in (FIGS. 7 and 8)
Figure 10:
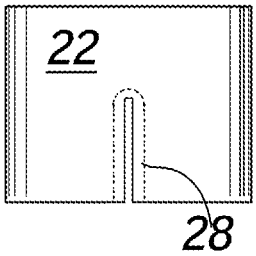
FIG. 10 depicts distancing means with curved member facing out.
Figure 11:
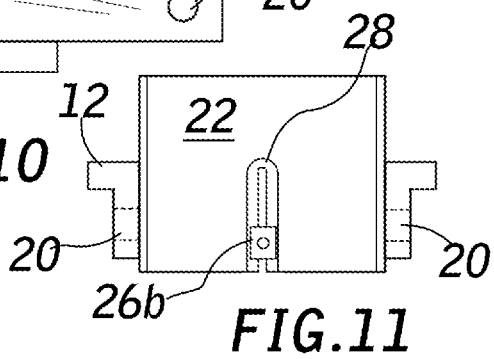
FIG. 11 depicts distancing means with curved member facing in, shown with sliding nut sliding within recessed channel.
Figures 12, 13:
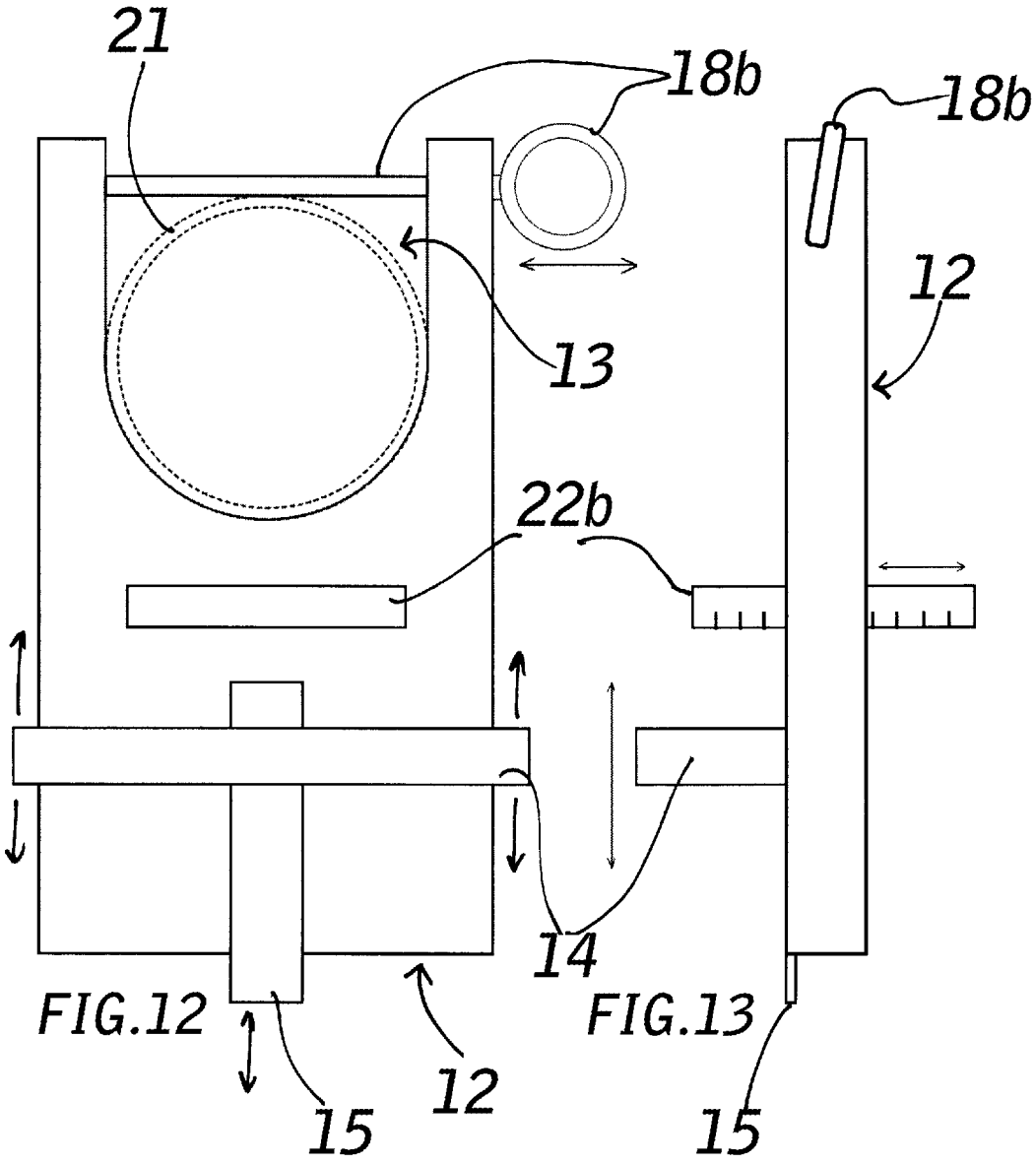
FIG. 12 depicts a side elevation of an alternate embodiment with sliding distancing member 22*b* with graduations to show and set platform offset from a pipe bracket.
FIG. 13 depicts a side elevation of the embodiment shown in (FIG. 12)
Figure 14:
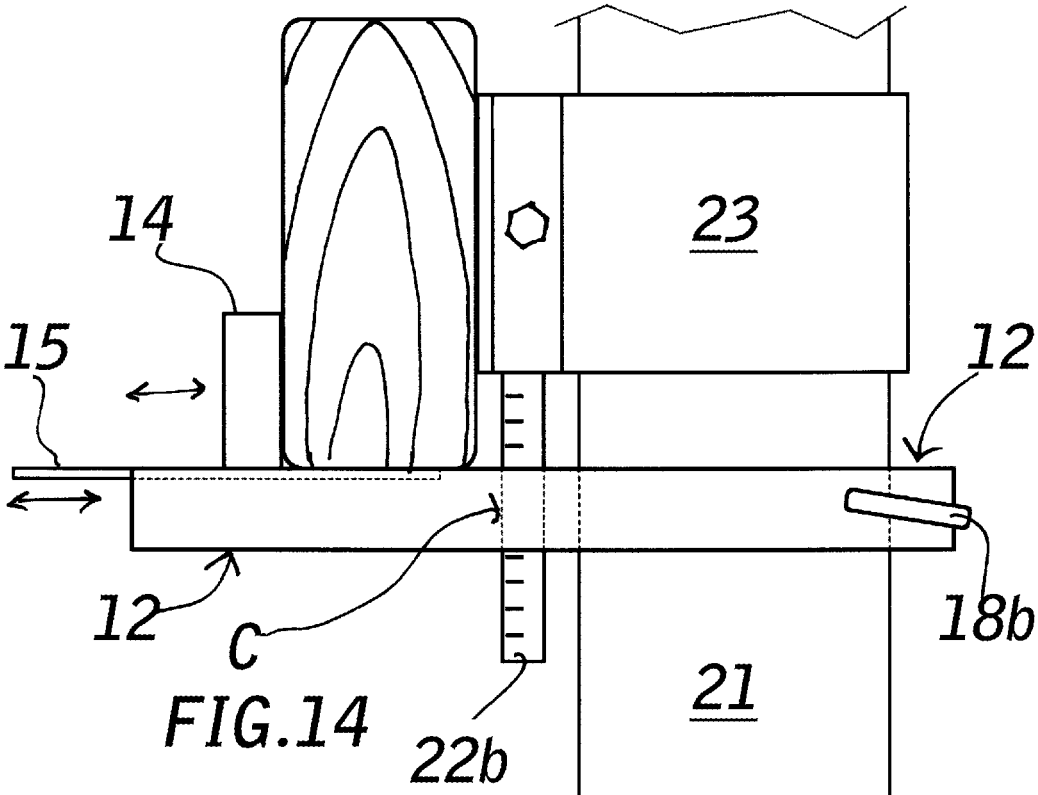
FIG. 14 depicts the embodiment shown in (FIG. 12) affixed to fence pipe.
Figure 15:
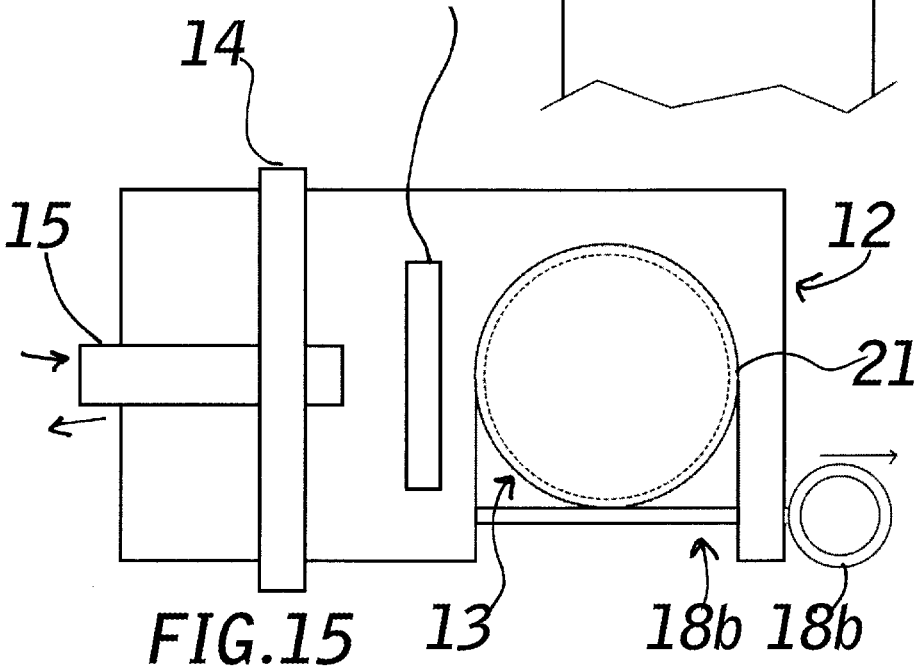
FIG. 15 depicts the embodiment shown in (FIG. 12) with a side opening.
Figures 19, 20, 21:
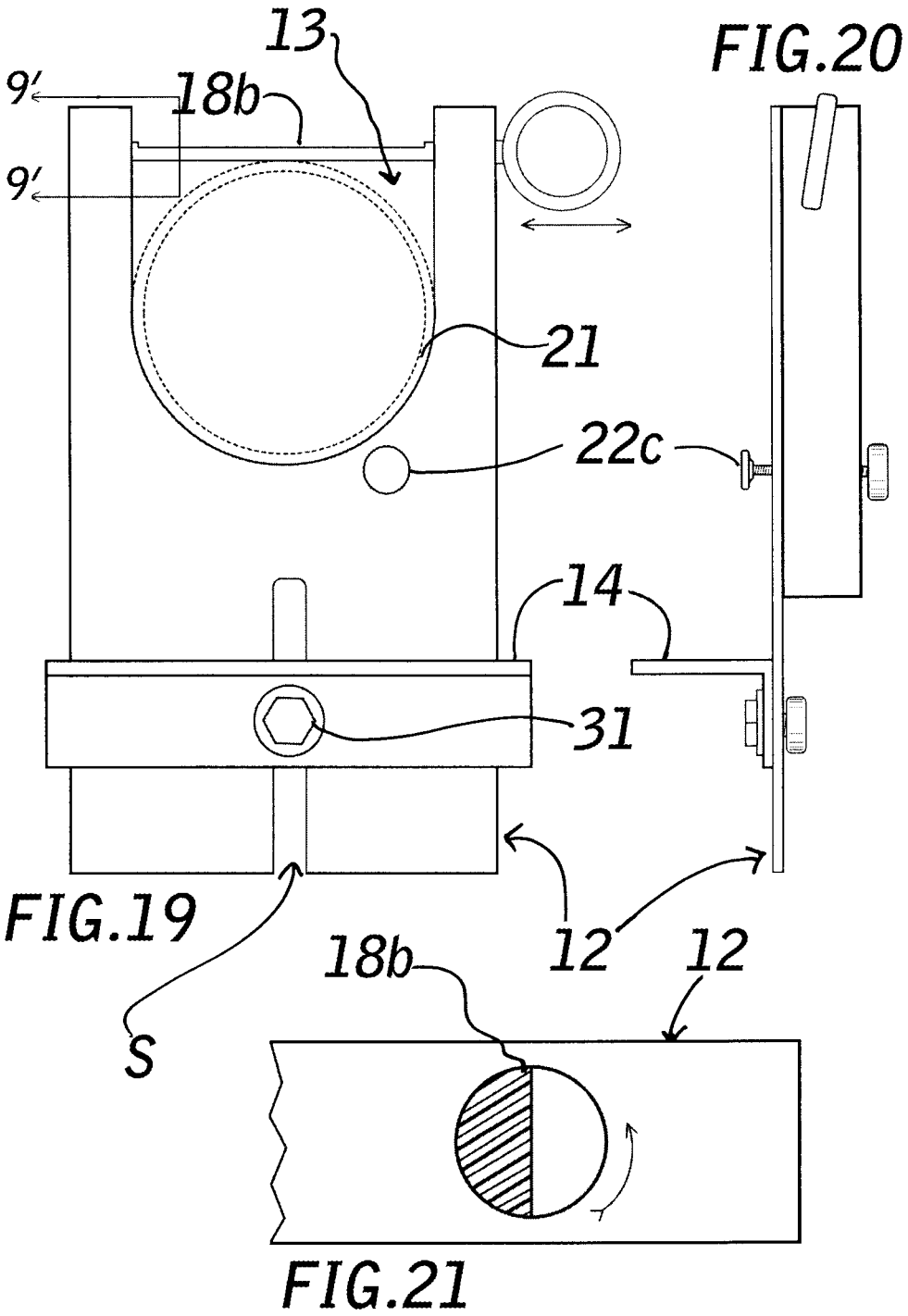
FIG. 19 depicts an alternate embodiment according to the present invention.
FIG. 20 is a side elevation of the embodiment shown in (FIG. 19)
FIG. 21 is a sectional view taken along lines 9'-9' of (FIG. 19)

Referring generally to FIGS. 1-30, a rail support 10 includes a platform 12 having at least a top surface for support of a fence rail, an opening 13 sized to receive a portion of a fence pipe 21, and which abuts at least a portion of a fence pipe diameter once the apparatus is positioned upon the fence pipe, a securing member for securing the apparatus to the fence pipe by closing the opening, and drawing the platform opening into progressively tighter contact with the fence pipe, and a retainer 14 which prevents undesired motion of the rail and keeps the rail in close proximity to rail attachment points defined by screw holes on the flanges of the pipe bracket 23. Furthermore, the platform can include a distancing means of fixed or variable height, or a combination of fixed and variable height, on either side of the platform. In FIGS. 1-4, ridges 16 formed into both sides of the platform generally follow the contour of the platform opening. It also should be noted that while the securing member shown in FIGS. 1-4 is an L-shaped wedge 18*a* which is reversibly insertable into guides 20 at opposite sides of the opening 13 as shown in FIG. 3, guides for a securing member can take the form of apertures or recesses when used with an inserted pin or rod 18*b* as shown in FIGS. 5-11, or a pivoting securing member 18*c* as shown in FIGS. 18-20 without deviating from the instant invention. FIGS. 5-11 show a combination of fixed and adjustable distancing means, in which ridge 16 extends preferably from only one side of the platform, and is supportive of an adjustable distancing member 22*a* which is somewhat arc-shaped, having both convex and concave sides. In one embodiment, FIG. 6 in a bottom view of the platform with ridge 16 extending outwardly, shows distancing member 22*a* nested in a recess (r) within ridge 16. In this case, the recess is sized to fit the distancing member in a friction fit, so the distancing member can be slid up or down within the recess to a desired height above the platform, to be retained in place by friction only. FIG. 8 is a bottom view of another embodiment in which ridge 16 has no recess, and distancing member 22*a* is adjacent the concave side of the ridge. In this case, the distancing member follows the curve of both the opening and the fixed ridge, and is adjacent and abutting thereto. FIG. 9 in a side elevation, shows a through-aperture (t) formed in the side of the fixed ridge 16 to accept a threaded portion of thumbscrew 26*a*. The distancing member and the platform are joined when the threaded portion of thumbscrew 26*a* passes through fixed ridge 16 and the sliding member, and is secured thereto a nut 26*b* that resides within a slot and recess 28 formed in the concave side of the distancing member 22*a* which is sized to permit the threaded portion and nut to slide therein. By tightening the thumbscrew, the height of the distancing member relative to the top surface of the platform can be easily adjusted and secured. The sliding distancing member can be removed, and the platform flipped in order to use ridge 16 as a fixed distancing member. Whether fixed or slidable, the uppermost edge of the distancing means is intended to abut a bottom portion of the pipe bracket so as to offset the distance between the center of the pipe bracket flanges and the rail so that common widths of rails are centered and level relative to the pipe bracket flanges. It should be noted that fixed ridges 16 of different heights can extend from both sides of the platform 12 as shown in FIGS. 1-4, permitting the platform to be affixed to the fence pipe 21 with either side facing up, in order to achieve two set distances that are sized to center rails having common nominal widths upon a pipe bracket flange. Preferably, the thickness of the sliding distancing member is between 1/16 inch and 1/2 inch, and even more preferably between 1/8 inch and 3/16 inch. The distancing member can be made of the same material as the platform, or any other sufficiently rigid material such as steel or aluminum.

Because the quality of fence rails varies widely with bowing being common, the purpose of retainer 14 is to retain an unattached rail close to the flange of the pipe bracket prior to fastening. The retainer for the rail is preferably a projecting member that abuts at least one surface of a supported rail and keeps the rail in close proximity to the flange attachment points. The retainer can be a lip simply molded into one end of the platform that prevents the rail from falling free of the platform, and which is fixed as shown in FIGS. 1-11, or can move somewhat like a miter gauge as shown in FIGS. 19-21. Alternately, the retainer can be a series of knobs, ridges, or rubberized tread on either surface of the platform to provide frictional resistance to rail movement. If the retainer is slidable, it slides within platform 12 similarly to a miter gauge on a table saw having a bottom portion sliding within a recess or slot formed in the platform. Other means of rail retention will no doubt suggest themselves to those having skill in the art and the benefit of this disclosure and are intended to be encompassed by the present invention.

The platform's opening is closed by a securing member that is most preferably a wedge 18*a* a removable rod 18*b* or a pivoting member 18*c*. While, the securing member preferably possesses reversibly compressible portions 20*a* (FIGS. 1 and 3), 20*b* (FIGS. 5 and 6), which can be elastomeric shapes that are bonded or overmolded to a pin or wedge which is progressively forced against the fence pipe 21 while being secured to the platform in order to progressively tighten the connection between the platform and the fence pipe, relatively non-compressible materials such as simple rod having adjacent regions of greater and lesser radii, such as shown in FIGS. 19 and 21, can be used. Once the securing member is fully engaged by forcing the compressible portion against the rear of the pipe, the platform is maintained in a substantially perpendicular position relative to the pipe. Ideally, the compressible portion which can be a length of rubber, a rubber bumper, a rubber tube over a sufficiently rigid rod, or some other elastomeric element, compresses even more when weight is applied to the platform. The result of such compression is a platform that can move very slightly angularly relative to the pipe, while remaining highly resistant to vertical movement along the pipe. The importance of this feature is that it gives the platform some resiliency when being loaded with a rail. The compressible member also accommodates slight differences in the diameter of the fence pipe which can vary by as much as 2 mil.

Figure 16:
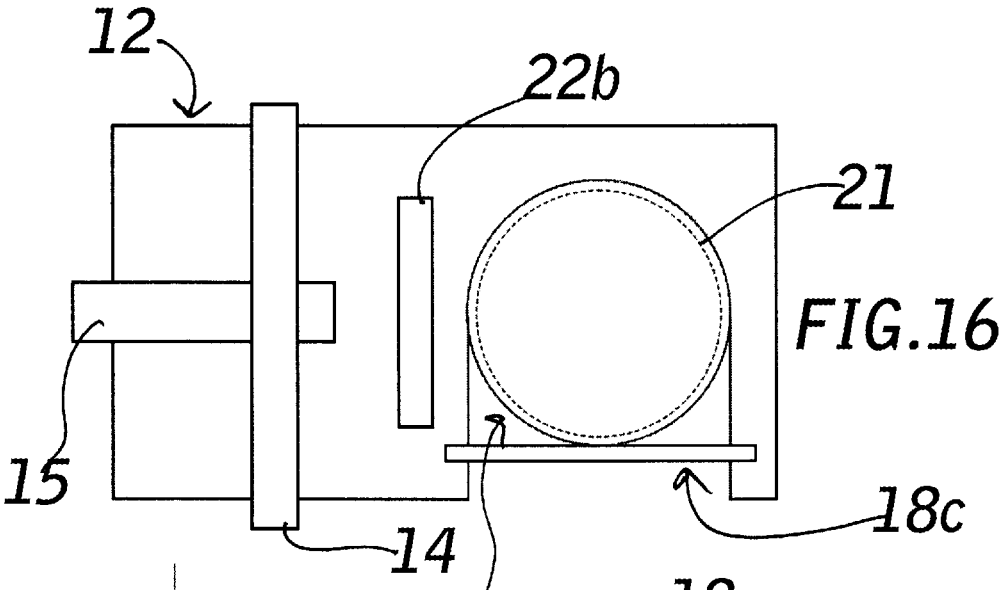
FIG. 16 depicts an embodiment with a side opening, and a pivotable securing member.
Figure 17:
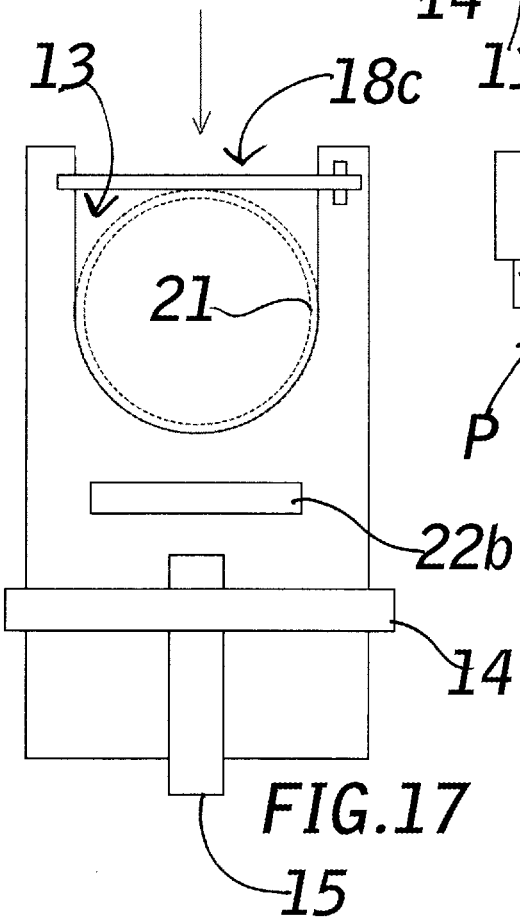
FIG. 17 depicts an embodiment with a rear opening and a pivotable member.
Figure 18:
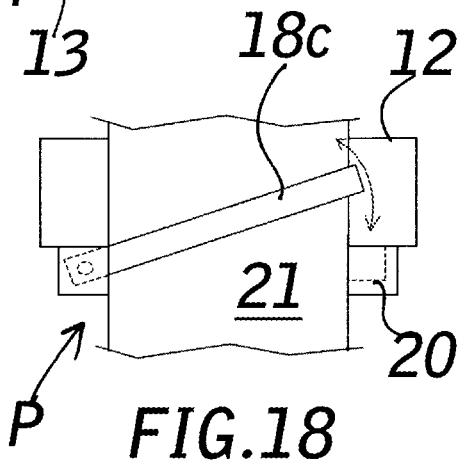
FIG. 18 depicts the embodiment of (FIG. 17) rearwardly, showing pivoting member reversibly securing the platform to a fence pipe by pivoting in and out of recess.

Moving to FIGS. 16-18, securing member 18*c* is pivotably connected to one side of the platform opening and has an opposite end which is nestable in a guide 20 formed into the opposite side of the platform opening, in order to close the opening. Conceivably, opposing ends of the securing member can be snapped or slid within recesses located on either side of the opening like that shown in FIGS. 1-4. In any case, the securing member, when removed, permits the removal of the rail support from the fence pipe.

The platform and distancing means can be formed from sheet stock, whether plastic, metal or other rigid material, or molded or cast from metal or plastic materials or a composite. Regarding the securing member, it is intended that a cross-section of the securing member encompass any irregular shape with an offset center, or portions having varying radii or thicknesses, so that the clearance between the securing member and the fence pipe is increased or decreased as required to firmly attach the platform, or loosen it for removal. It is conceivable that a spacer can be placed between an edge of a rail and the platform to raise or lower the rail relative to the pipe bracket for centering purposes. For standard milled lumber supplied in the nominal widths of 2.5 inches, 3.5 inches, and 3.75 inches, the fixed distancing means extends from both sides of the platform, permitting the platform to be flipped to accommodate (center) the various widths. For example, the fixed ridge of lesser height can center a 2.5 inch width rail relative to the most common pipe bracket, while the ridge of greater height centers the 3.75 inch width rail. A ¼ inch spacer is placed on the platform to center the 3.5 inch rail relative to the bracket flange.

Figures 22, 23, 24:
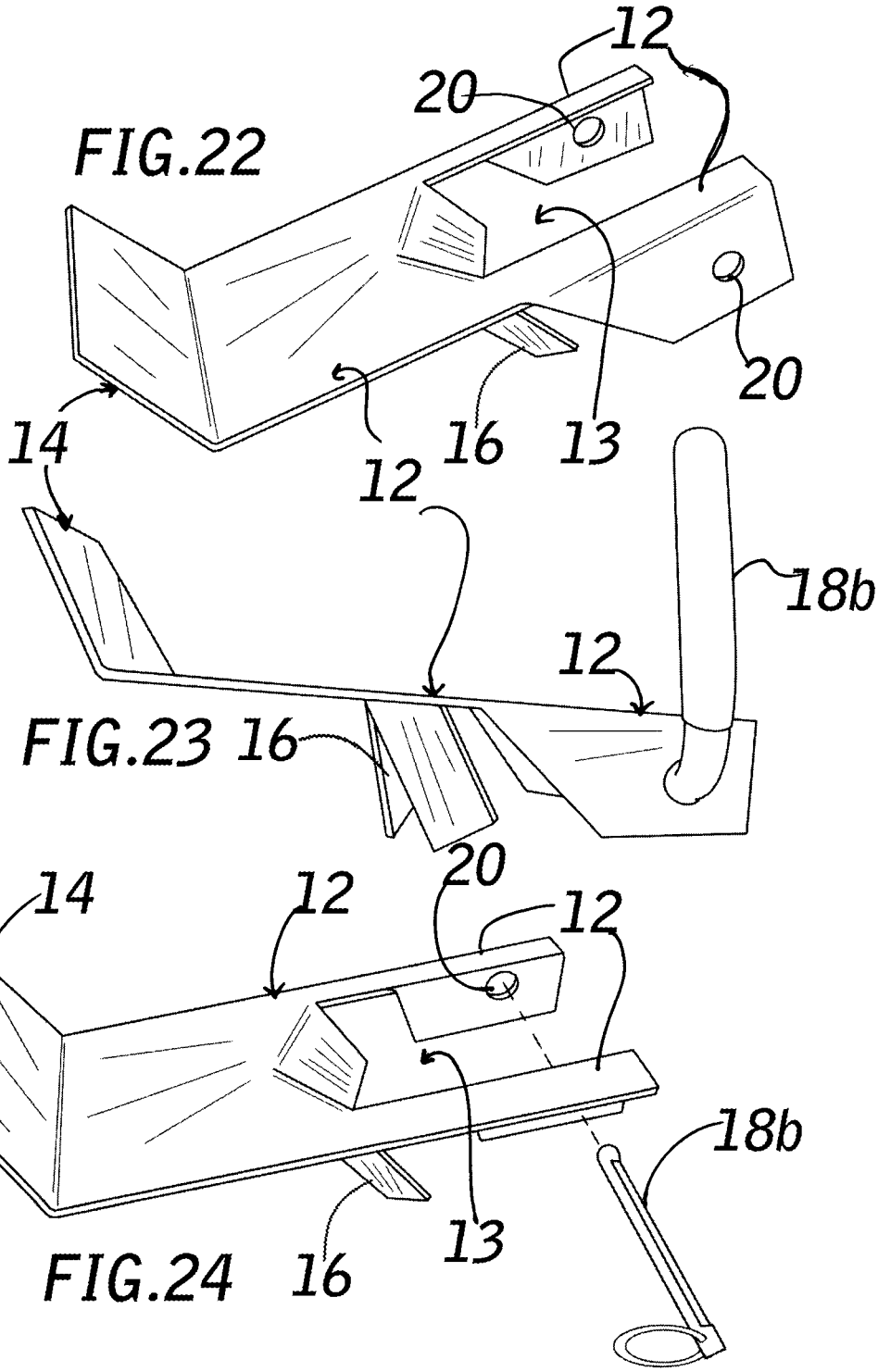
FIG. 22 is a side perspective view of another embodiment according to the present invention, as seen from the top.
FIG. 23 is a side perspective view of the embodiment shown in (FIG. 22) as seen from the bottom.
FIG. 24 is a side perspective view of the embodiment shown in (FIG. 22) with flanges forming arms with guides bent inwardly relative to opening.
Figure 25:
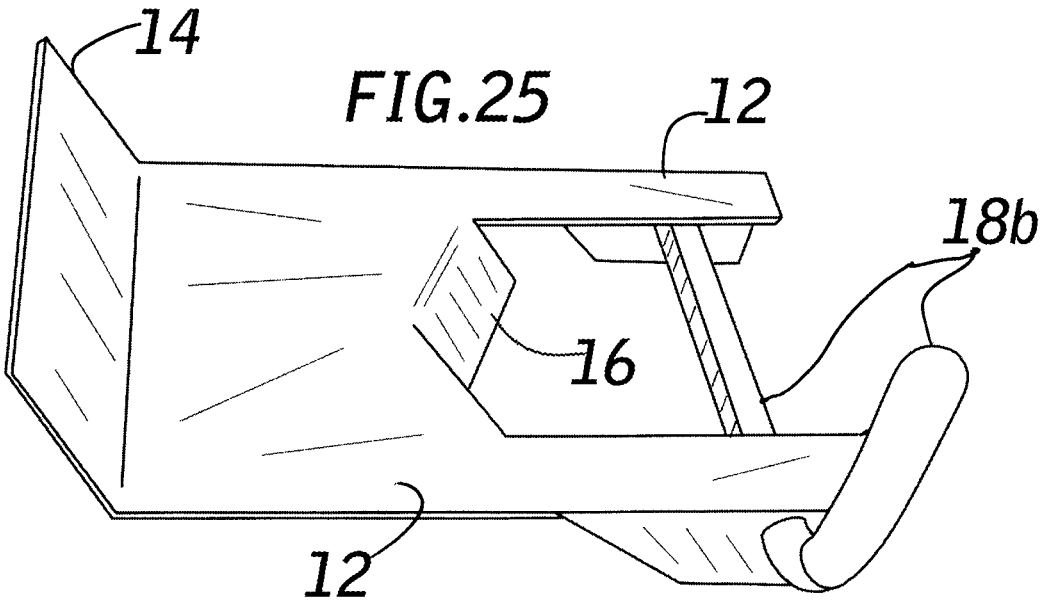
FIG. 25 is a side perspective view of the embodiment shown in (FIG. 22) as seen from the top side of the platform.
Figure 26:
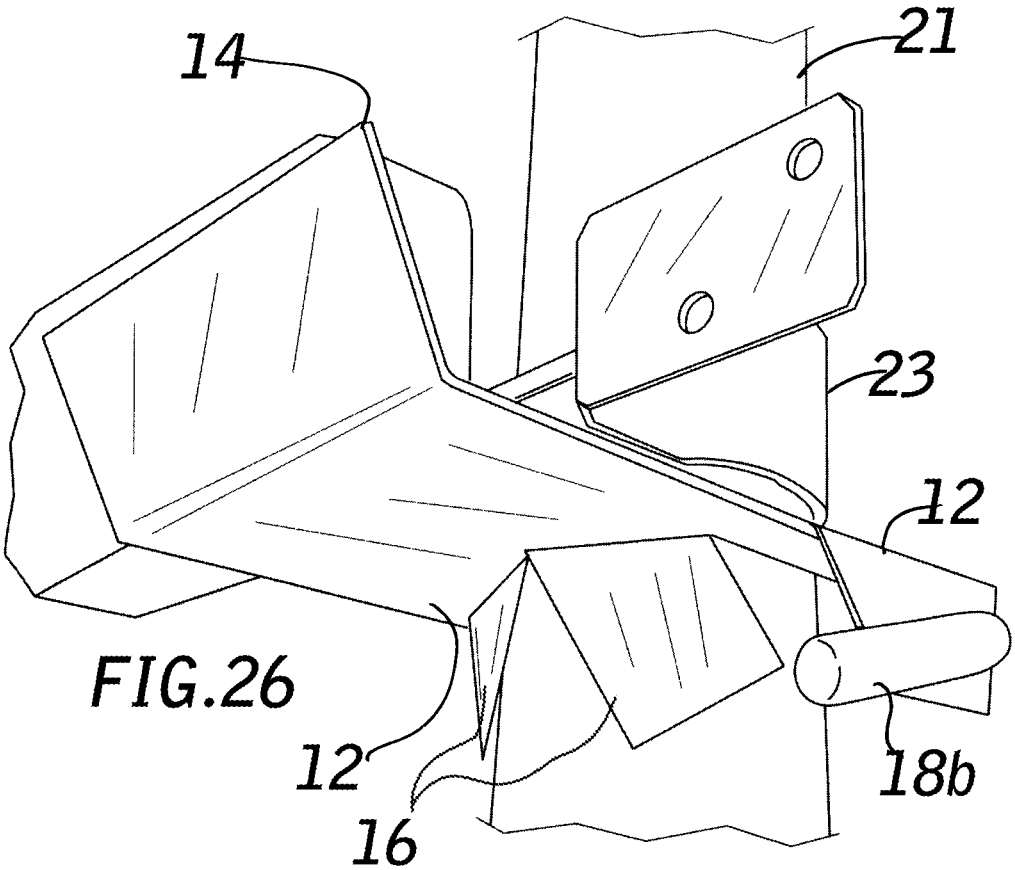
FIG. 26 is a side perspective view of the embodiment shown in (FIG. 22) mounted on a fence pipe, with flanges forming arms with guides bent outwardly relative to opening for receiving securing member 18*b;*

FIGS. 27-30 show sections of sheet material that can be formed into embodiments like that shown in FIG. 22, and according to the present invention, by stamping and bending sheet metal. Solid lines indicate cut-through sections. Dashed lines indicate where cuts are made to a previously stamped piece of sheet metal sheet stock. Flanges (A1,A2) and (B1.B2) are bent downwardly, away from the top surface of the platform. A1 and as have guide apertures 20 formed therein for the insertion of securing member 18*b*. B1 and B2 provide contacting regions adjacent platform opening 13 for contact with the fence pipe when placed thereagainst.

While the invention has been described by the embodiments given, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. In combination with a fence pipe and a fence pipe bracket, an apparatus for the temporary support, positioning, and affixing of fence rails to a pipe bracket, comprising:

(1) a platform with first and second ends, an opening which is semi-circular being adjacent to the first end and the second end having a through section including arms with a recess to admit a section of the fence pipe for reversible mounting thereto, (2) a reversibly engage-able securing member which is removeably attachable within the recess of the arm that when engaged, closes the opening and forces a portion of the opening opposite the securing member, into a tight friction fit with the fence pipe, and (3) wherein the platform further comprises at least one projecting portion for contact with at least one side of a rail to retain the rail in an upright position for fastening to the pipe bracket.

2. The apparatus of claim 1, further comprising an adjustable distancing means that abuts a bottom portion of the pipe bracket which is sized to permit rails to be vertically centered relative to flanges on the pipe bracket.

3. In combination with a fence pipe and a fence pipe attachment bracket for fence rails, an apparatus for the temporary support of fence rails being affixed to the attachment brackets comprising:

(1)a platform reversibly mountable to a fence pipe with first and second ends, an opening which is adjacent to the first end and the second end having a through section including arms with a recess to admit a section of the fence pipe, (2) retention member stopping vertical and horizontal movement of the rails while being temporarily supported, including at least one projecting member atop the platform for contact with a face of the rail, (3) a reversibly engage-able securing member which is removeably attachable within the recess of the arm that when engaged, closes the opening and forces a portion of the opening opposite the securing member, into a tight friction fit with the fence pipe.

4. The apparatus according to claim 3 further comprising a means for leveling and centering the rail relative to the attachment bracket including a distancing member extending from an attached platform and contacting a bottom surface of the attachment bracket for determining distance between the rail supporting surface and the bracket.

* * * * *